United States Patent [19]

Takeuchi et al.

[11] Patent Number: 4,700,896

[45] Date of Patent: Oct. 20, 1987

[54] ROTARY TYPE ELECTROSTATIC SPRAY PAINTING DEVICE

[75] Inventors: Hitoshi Takeuchi; Shogo Ooishi, both of Toyota, Japan

[73] Assignee: Toyota Jidosha Kabushiki Kaisha, Toyota, Japan

[21] Appl. No.: 850,745

[22] Filed: Apr. 11, 1986

[51] Int. Cl.[4] ..... B05B 5/04

[52] U.S. Cl. ..... 239/693; 239/113; 239/119; 239/121; 239/223; 239/703

[58] Field of Search ..... 239/112, 113, 119, 223, 239/224, 693, 700, 701, 702, 703, 708, 120, 121

[56] References Cited

U.S. PATENT DOCUMENTS

| | | | |
|---|---|---|---|
| 2,123,156 | 7/1938 | Jagoe | 239/119 |
| 2,650,003 | 8/1953 | Coleman | 239/113 |
| 3,857,513 | 12/1974 | Wiggins | 239/112 |
| 4,373,673 | 2/1983 | Morishita et al. | 239/703 |
| 4,403,736 | 9/1983 | Scharfenberger | 239/112 |
| 4,422,576 | 12/1983 | Saito et al. | 239/693 |
| 4,605,168 | 8/1986 | Tachi et al. | 239/703 |

FOREIGN PATENT DOCUMENTS

| | | | |
|---|---|---|---|
| 58-124254 | 8/1983 | Japan | 239/703 |

*Primary Examiner*—Andres Kashnikov
*Assistant Examiner*—Michael J. Forman
*Attorney, Agent, or Firm*—Oblon, Fisher, Spivak, McClelland & Maier

[57] ABSTRACT

A rotary type electrostatic spray painting device comprising a rotary shaft supported by static pressure air bearings in a non-contact state. A drive turbine wheel and a braking turbine wheel are fixed to the rotary shaft. A paint injection nozzle is provided for feeding paint onto a cup shaped inner wall of the spray head. The paint injection nozzle is connected to a paint suction device. When changing the color of the paint, pressurized air is injected towards the braking turbine wheel and, at the same time, paint remaining in the paint injection nozzle is sucked away by the paint suction device.

15 Claims, 2 Drawing Figures

ROTARY TYPE ELECTROSTATIC SPRAY PAINTING DEVICE

BACKGROUND OF THE INVENTION

1. Field of the Invention

The present invention relates to a rotary type electrostatic spray painting device.

2. Description of the Related Art

In a painting operation line for painting bodies of motor vehicles, a method of painting the color determined for each body conveyed on the painting line is normally adopted. Consequently, where the color of the paint now used is different from the color to be painted next, it is necessary to clean the rotary type electrostatic spray painting device during the time elapsing between the completion of the painting operation of one vehicle body and the starting of the painting operation of the next vehicle body. At present, it takes a very long time to clean the painting device, and the conveyer speed of the painting line depends on such a cleaning time. Consequently, it is very important to shorten the cleaning time in order to increase the speed of the conveyer, and thereby increase productivity.

Where a clear paint or solid paint is sprayed by a rotary type electrostatic spray painting device, a good paint surface can be obtained by rotating the spray head of the painting device at about 15,000 r.p.m. However, where metallic paint is sprayed by the rotary type electrostatic spray painting device, if the rotating speed of the spray head is lower than 45,000 r.p.m. pieces of aluminium foil contained in the metallic paint can not be suitably aligned with each other, and a good finish can not be obtained. As a result, it is difficult to obtain a good paint surface.

The spray head of the painting device is normally rotated by means of an air turbine. When the color of the paint to be sprayed is to be changed, the air injecting operation by the turbine nozzles is stopped so that the rotating speed of the spray head decreases. Then the cleaning operation of the painting device is carried out. However, where the spray head is rotated at about 45,000 r.p.m., even if the air injecting operation by the turbine nozzles is stopped in order to change the color of the paint, about ten seconds must pass before the rotating speed of the spray head is reduced to 30,000 r.p.m. This causes a drawback in that, if a cleaning liquid, that is, thinner, is fed onto the spray head while the spray head is rotated at about 30,000 r.p.m, waste thinner containing paint therein is scattered, and this scattered waste thinner adheres to the housing of the painting device. Subsequently, when the operation of painting the following vehicle body is carried out, the waste thinner on the housing of the painting device is attracted towards the vehicle body to be painted, due to the electrostatic force, and adheres thereto, causing paint defects. Consequently, where the spray head is rotated at over 45,000 r.p.m. in order to spray metallic paint, when the supply of air from the turbine nozzles is stopped in order to change the color of the paint, it is necessary to wait for a long time until the rotating speed of the spray head is considerably reduced. This results in a problem in that the time for cleaning the spraying device becomes overlong.

SUMMARY OF THE INVENTION

An object of the present invention is to provide a rotary type electrostatic spray painting device capable of improving the productivity by shortening the cleaning time thereof.

According to the present invention, there is provided a rotary type electrostatic spray painting device comprising: a housing; a rotary shaft rotatably arranged in the housing and having an inner end portion and an outer end portion; a spray head fixed to the outer end portion of the rotary shaft and having a cup shaped inner wall; a paint injection nozzle for feeding paint onto the cup shaped inner wall; at least two color valves connected to the paint injection nozzle for controlling the paint injecting operation from the paint injection nozzle; a paint suction means for sucking paint remaining in the paint injection nozzle; means for generating a negative high voltage and applying the negative voltage to the spray head; static pressure air bearings arranged in the housing and supporting the rotary shaft in a non-contact state; a turbine wheel fixed to the inner end portion of the rotary shaft; a first air injection nozzle injecting pressurized air towards the turbine wheel to rotate the rotary shaft in one direction; a second air injection nozzle injecting pressurized air towards the turbine wheel to provide a rotational force in another direction for the drive shaft and thus reduce the speed of rotation of the rotary shaft; an air source producing pressurized air; a first air supply conduit interconnecting the air source to the static pressure air bearings; a second air supply conduit interconnecting the air source to the first air injection nozzle; a first valve arranged in the second air supply conduit; a third air supply conduit interconnecting the air source to the second air injection nozzle; a second valve arranged in the third air supply conduit; and control means for controlling the opening operation of the first valve and the second valve and controlling the sucking operation of the paint suction means to open the first valve; close the second valve; and stop the sucking operation of the paint suction means when the painting operation is carried out, and to close the first valve means, open the second valve, and carry out the sucking operation of the paint suction means when changing the color of the paint.

The present invention may be more fully understood from the description of a preferred embodiment of the invention set forth below, together with the accompanying drawings.

DESCRIPTION OF A PREFERRED EMBODIMENT

Figure 1:
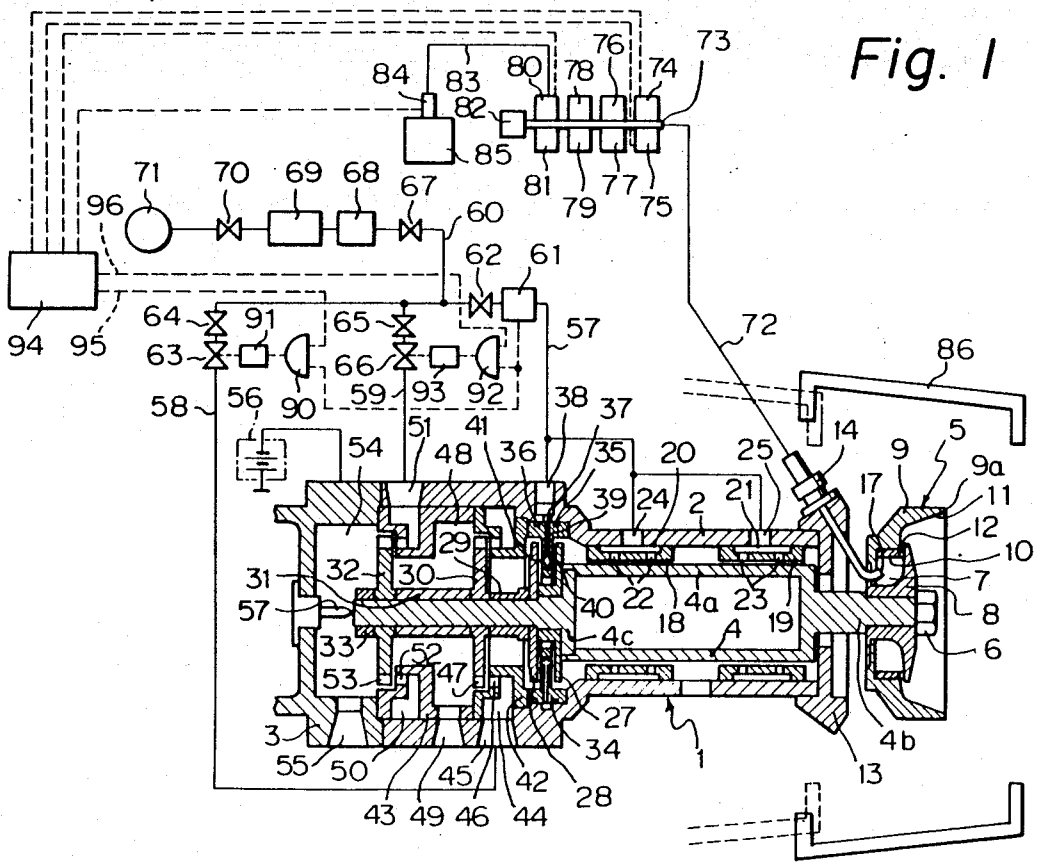
FIG. 1 is a cross-sectional side view of a rotary type electrostatic spray painting device according to the present invention.

Referring to FIG. 1, a rotary type electrostatic spray painting device generally designated by reference numeral 1 comprises a hollow cylindrical front housing 2 made of metallic material, and a hollow cylindrical rear housing 3 made of metallic material. The housings 2 and 3 are firmly connected to each other by means of bolts (not shown). A rotary shaft 4 is inserted into the front housing 2. The rotary shaft 4 comprises a hollow cylindrical portion 4*a* located at the central portion thereof, an outer end portion 4*b* integrally formed with the hollow cylindrical portion 4*a*, and an inner end portion 4c fixed to the hollow cylindrical portion 4a. A spray head 5 made of metallic material is fixed to the outer end portion 4b of the rotary shaft 4 by means of a nut 6. The spray head 5 comprises a spray head supporting body 8 defining an annular space 7 therein, and a cup shaped spray head body 9 fixed to the spray head supporting body 8. A plurality of paint outflow bores 12 are formed in an outer cylindrical portion 10 of the spray head supporting body 8. Each of the paint outflow bores 12 is open to the annular space 7 on one hand and is smoothly connected to the cup shaped inner wall 11 of the spray head body 9. An end plate 13 is fixed to the front end of the front housing 2, and a paint injection nozzle 14 is mounted on the end plate 13. The paint injection nozzle 14 is connected to a manifold 73 via a paint feed conduit 72, and a nozzle mouth 17 of the paint injection nozzle 14 is directed towards an inner cylindrical wall of the outer cylindrical portion 10.

A plurality of color valves 74, 75, 76, 77, 78 and 79, a thinner valve 81, an air valve 82, and a suction control valve 80 are mounted on the manifold 73. The color valves 74, 75, 76, 77, 78 and 79 are connected to corresponding paint feed pumps (not shown), and the thinner valve 81 is connected to a thinner feed pump (not shown). The air valve 82 is connected to a pressurized air source (not shown). The suction control valve 80 is connected to a paint suction device 84 formed by an ejection or a diaphragm pump via a suction conduit 83, and the paint suction device 84 is connected to a waste liquid tank 85.

As illustrated in FIG. 1, a pair of static pressure radial air bearings 18 and 19 (hereinafter referred to as the radial air bearings) are arranged in the front housing 2, and the rotary shaft 4 is rotatably supported by the radial air bearings 18 and 19 in a non-contact state. The radial air bearings 18 and 19 have annular air chambers 20 and 21 formed therein, respectively, and a plurality of air outflow bores 22, 23 connected respectively to the corresponding annular chambers 20, 21 are formed on the bearing faces of the radial air bearings 18, 19. An air inlet 24 of the air chamber 20 and an air inlet 25 of the air chamber 21 are connected to a pressurized air source 71 formed by an air feed pump.

As illustrated in FIG. 1, a pair of disc shaped runners 27, 28 are rigidly fixed to the inner end portion 4c of the rotary shaft 4 via a spacer 29, a drive turbine wheel 30, a spacer 31, and a braking turbine wheel 32 by means of a nut 33. A stationary annular plate 34 is arranged between the runners 27 and 28, and the runners 27, 28 and the annular plate 34 together form a non-contact type static pressure thrust air bearing (hereinafter, thrust air bearing). The runners 27, 28 are slightly spaced from the annular plate 34. The annular plate 34 is airtightly fixed to the front housing 2 via O rings 35, 36. As illustrated in FIG. 1, an annular groove 37 extending along the outer circumferential wall of the annular plate 34 is formed in the front housing 2 and connected to the air feed pump 71 via the air inlet 38 formed in the front housing 2. A plurality of air passages 39, each extending radially inwardly from the annular groove 37, are formed in the annular plate 34, and a plurality of air outflow bores 40, 41 extending towards the corresponding runners 27, 28 from the inner end portions of the air passages 39 are also formed in the annular plate 34.

A pair of turbine nozzle holders 42, 43 are arranged in the front housing 2. An annular air chamber 44 is formed between the turbine nozzle holder 42 and the front housing 2 and connected to the air feed pump 71 via an air inlet 45. The air chamber 44 has an air injection nozzle 46 in which a plurality of guide vanes (not shown) are arranged. The air injection nozzle 46 is arranged so that the turbine blades 47 of the drive turbine wheel 30 face the air injection nozzle 46. Air under pressure introduced into the air chamber 44 from the air feed pump 71 is injected from the air injection nozzle 46 into a housing interior chamber 48. At this time, the injecting air provides a rotational force for the drive turbine wheel 30, and thus the rotary shaft 8 is rotated at a high speed. Air in the housing interior chamber 48 is then discharged from a discharge part 49. An annular air chamber 50 is formed between the turbine nozzle holder 43 and the front housing 2 and connected to the air feed pump 71 via an air inlet 51. The air chamber 50 has an air injection nozzle 52 in which a plurality of guide vanes (not shown) are arranged. The air injection nozzle 52 is arranged so that the turbine blades 53 of the braking turbine wheel 32 face the air injection nozzle 52. Air under pressure introduced into the air chamber 50 from the air feed pump 71 is injected from the air injection nozzle 52 into a housing interior chamber 54. At this time, the injected pressurized air provides a rotational force in a direction which causes the braking turbine wheel 32 to act as a brake on the rotary shaft 4. This direction is opposite to the direction of rotation of the rotary shaft 4, which rotation is caused by pressurized air injected from the air injection nozzle 46 towards the turbine blades 47 of the drive turbine wheel 30, causing the drive turbine wheel 39 to rotate the rotary shaft 4. Air in the housing interior chamber 54 is then discharged from a discharge port 55.

The rotary type electrostatic spray painting device 1 is connected to a high voltage generator 56 generating a negative high voltage of −60 KV to −90 KV, and this negative high voltage is applied to the front housing 2 and the rear housing 3. The negative high voltage is then applied to the rotary shaft 4 via an electrode 57, and thus is applied to the spray head 5.

As illustrated in FIG. 1, a main air supply conduit 60 connected to the air feed pump 71 is divided into three air supply conduits 57, 58, and 59. The first air supply conduit 57 is connected to the air inlet 38 of the thrust air bearing and the air inlets 24, 25 of the radial air bearings 18, 19. The second air supply conduit 58 is connected to the air inlet 45 of the turbine nozzle holder 42. The third air supply conduit 59 is connected to the air inlet 51 of the turbine nozzle holder 43. An air heating device 69 for vaporizing water droplets contained in the pressurized air is arranged in the main air supply conduit 60, and a regulator 68 for maintaining the pressurized air at a predetermined pressure is also arranged in the main air supply conduit 60. In addition, a stop valve 70 is arranged in the main air supply conduit 60 upstream of the air heating device 69, and another stop valve 67 is arranged in the main air supply conduit 60 downstream of the regulator 68. A detector 61 for detecting the pressure or the flow rate of the pressurized air flowing within the first air supply conduit 57 is arranged in the first air supply conduit 57 and, in addition, a stop valve 62 is arranged in the first air supply conduit 57. A stop valve 64 and a solenoid valve 63 actuated in response to the output signal of the detector 61 are arranged in the second air supply conduit 58, and a stop valve 65 and a solenoid valve 66 actuated in response to the output signal of the detector 61 are arranged in the third air supply conduit 59. The solenoid valve 63 is connected to the output terminal of an AND gate 90 via a drive circuit 91, and the solenoid valve 66 is connected to the output terminal of an AND gate 92 via a drive circuit 93. One of the input terminals of the AND gate 90 and one of the input terminals of the AND gate 92 are connected to the output terminal of the detector 61, and the other input terminals of the AND gates 90, 92 are connected to the output terminals of a drive control device 94. The output voltage of the detector 61 becomes high when the pressure or the flow rate of the pressurized air flowing within the first air supply conduit 57 exceed a predetermined level, and the solenoid valves 63 and 66 are opened when the output voltages of the corresponding AND gates 90 and 92 become high.

The drive control of the drive turbine wheel 30 and the braking turbine wheel 32 is automatically carried out in response to the signals output from the drive control device 94. When the output voltage appearing in the output lead 95 of the drive control device 94 becomes high, in order to drive the drive turbine wheel 30, if the pressure or the flow rate of the pressurized air flowing within the first air supply conduit 57 is higher or larger than the predetermined level, the output voltage of the AND gate 90 becomes high, and thus the solenoid valve 63 is caused to open. When the output voltage appearing in the output lead 96 of the drive control device 94 becomes high, in order to drive the braking turbine wheel 32, if the pressure or the flow rate of the pressurized air flowing within the first air supply conduit 57 is higher or larger than the predetermined level, the output voltage of the AND gate 92 becomes high, and thus the solenoid valve 66 is caused to open. When the output voltage appearing in either the output lead 95 or the output lead 96 becomes high, if the pressure or the flow rate of the pressurized air flowing within the first air supply conduit 57 is lower or smaller than the predetermined level, the output voltages of the AND gates 90, 92 are low, and thus, the solenoid valves 63, 66 remain closed. In the embodiment illustrated in FIG. 1, the output voltages appearing in both the output leads 95 and 96 do not become high at the same time, and therefore, the solenoid valves 63 and 66 do not open at the same time.

As mentioned previously, the rotary shaft 4 is supported by a pair of radial air bearings 18, 19 and by a thrust air bearing constructed by the runners 27, 28 and the annular plate 34. In the radial air bearings 18, 19, when the pressure or the flow rate of the pressurized air is higher or larger than the predetermined level when the air flows from the air outflow bores 22, 23, an air layer is formed between the outer circumferential wall of the hollow cylindrical portion 4*a* of the rotary shaft 4 and the bearing faces of the radial air bearings 18, 19. Consequently, at this time, the rotary shaft 4 is supported in a non-contact state by this air layer. In the thrust air bearing, when the pressure or the flow rate of the pressurized air is higher or larger than the predetermined level when the air is fed from the air outflow bores 40, 41 into the clearances between the annular plate 34 and the runners 27, 28, an air layer is formed between the annular plate 34 and the runners 27, 28. Consequently, at this time, the runners 27, 28 are supported in a non-contact state by this air layer. That is, if a sufficient amount of pressurized air is fed into the radial air bearings 18, 19 and the thrust air bearing, the rotary shaft 4 is supported by these air bearings in a non-contact state due to the intervention of the air layers therebetween.

Figure 2:
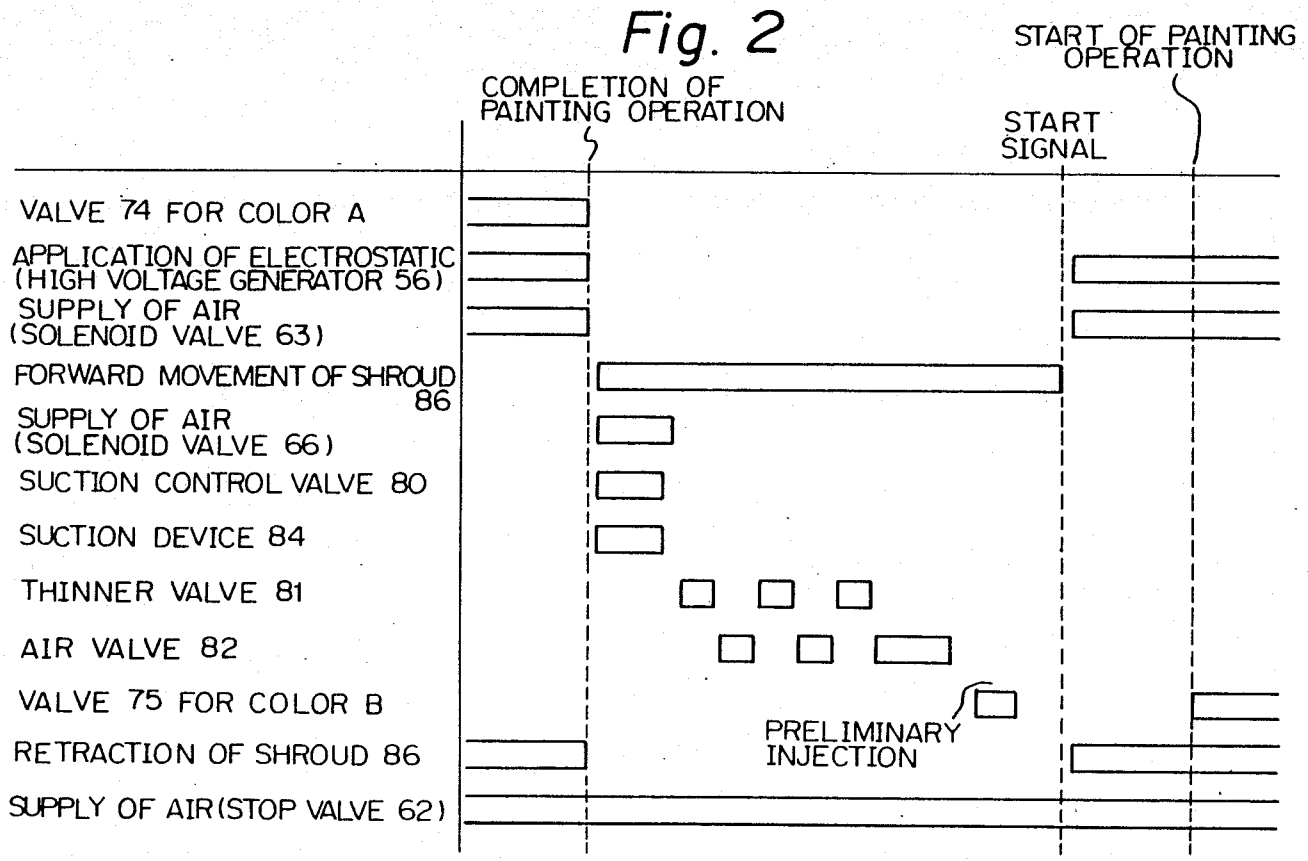
FIG. 2 is a time chart illustrating the painting operation.

The operation of the rotary type electrostatic spray painting device 1 in the painting line on which vehicle bodies to be painted are continuously conveyed will be described with reference to FIGS. 1 and 2. FIG. 2 illustrates a time chart of a typical cleaning operation in the case where the color of the paint is changed from color A to color B.

When the electrostatic spray painting device 1 is operated, all of the stop valves 62, 64, 65, 67, 70 are open, and pressurized air is fed into the radial air bearings 18, 19 and the thrust air bearing. When the painting operation is carried out, the output voltage appearing in the output lead 95 of the drive control device 94 becomes high. At this time, if an amount of pressurized air sufficient to support the rotary shaft 4 in a non-contact state is fed into the radial air bearings 18, 19 and the thrust air bearing, the solenoid valve 63 is caused to open. As a result, since pressurized air is injected from the air injection nozzle 46, the rotary shaft 4 is rotated at about 45,000 r.p.m. At this time, a shroud 56 for surrounding the spray head 5 is in a retracted position illustrated by the broken line in FIG. 1.

When a vehicle body to be painted, approaches the rotary type electrostatic spray painting device 1, the drive control device 94 produces a start signal. When the start signal is produced, the high voltage generator 56 is operated and thus a negative high voltage is applied to the spray head 5. In addition, if the drive control device 94 produces a painting start signal for color A, the color valve 74 for color A is opened. Consequently, at this time color A paint is injected from the paint injection nozzle 14 into the annular space 7 of the spray head 5 via the manifold 73 and the paint feed conduit 72. The paint injected from the nozzle mouth 17 of the paint injection nozzle 14 onto the inner circumferential wall of the outer cylindrical portion 10 of the spray head 5 flows out onto the inner wall 11 of the spray head body 9 via the paint outflow bores 12, due to the centrifugal force caused by the corresponding rotation of the spray head 5. The paint then spreads over the inner wall 11 of the spray head body 9 and flows on the inner wall 11 in the form of a thin film, until the paint reaches the tip 9*a* of the spray head body 9. As mentioned previously, a negative high voltage is applied to the spray head 5. Consequently, when the paint is sprayed from the tip 9*a* of the spray head body 9 in the form of fine particles, the particles of the sprayed paint are charged with electrons. Since the surface to be painted is normally grounded, the paint particles charged with electrons are attracted towards the surface to be painted due to electrical force, thus forming a layer of paint on the surface to be painted.

When the vehicle body to be painted has passed through the rotary type electrostatic spray painting device 1, the drive control device 94 produces a painting operation completion signal. At this time, the operation of the high voltage generator 94 is stopped, and the color valve 74 for color A is closed. In addition, the drive control device 94 has already produced a color signal representing the color of the paint which should be painted in the next painting operation, before the drive control device 94 produces the above-mentioned painting operation completion signal. If the next color is B, the color of the paint must be changed. If the drive control device 94 has already produced a color B signal, when the drive control device 94 produces the above-mentioned painting operation completion signal, the solenoid valve 63 is closed and thus the supply of air under pressure to the drive turbine wheel 30 is stopped. At the same time, the output voltage appearing in the output lead 96 of the drive control device 94 becomes high. At this time,if an amount of pressurized air sufficient to support the rotary shaft 4 in a non-contact state is fed into the radial air bearings 18, 19 and the thrust air bearing, the solenoid valve 66 is opened. As a result, pressurized air injected from the air injection nozzle 52 provides a rotational force in a direction which causes the turbine wheel 32 to act as a brake on the rotary shaft 4. This direction is opposite to the direction of rotation caused by pressurized air injected from the air injection nozzle 46, and thus the rotating speed of the rotary shaft 4 is rapidly reduced. In addition, the shroud 86 is caused to move forward to a position at which it surrounds the spray head 5, as illustrated by solid lines in FIG. 1.

When the supply of air to the braking turbine wheel 30 is started, the suction control valve 80 is opened and, at the same time, the paint suction device 84 is operated. As a result, the color A paint remaining in the paint injection nozzle 14, the paint feed conduit 72, and the manifold 73 is sucked into the waste liquid tank 85 by means of the paint suction device 84.

After the supply of air under pressure to the braking turbine wheel 32 is started, that is, after the sucking operation of the paint suction device 84 is started, the rotating speed of the spray head 5 is reduced to about 10,000 r.p.m. in about 5 sec. Consequently, air under pressure is fed to the braking turbine wheel 32 for about 5 sec. Then, the thinner valve 81 and the air valve 82 are alternately opened. As a result, the manifold 73, the paint feed conduit 72, and the paint injection nozzle 14 are cleaned by thinner and air and, at the same time, the paint outflow bores 12 and the cup shaped inner wall 11 of the spray head 5 are also cleaned. The waste liquid comprising waste thinner and waste paint is trapped by the shroud 86 and then collected in the waste liquid tank 85 by means of the diaphragm pump and the like (not shown).

When the cleaning operation is completed, the color valve 75 for color B is temporarily opened, and the interiors of the manifold 73, the paint feed conduit 72, and the paint injection nozzle 14 are filled with the color B paint, that is, a so-called preliminary injection of the color B paint is carried out. At this time, a small amount of the color B paint flowing from the paint injection nozzle 14 is trapped by the shroud 86.

Before completion of the preliminary injection, the solenoid valve 66 is closed and thus the supply of air under pressure to the braking turbine wheel 32 is stopped. After completion of the preliminary injection, the solenoid valve 63 is opened, and the drive turbine wheel 30 is driven. After the driving operation of the drive turbine wheel 30 is started, the rotating speed of the spray head 5 is increased to about 45,000 r.p.m. in two or three seconds. When the driving operation of the drive turbine wheel 30 is started, the shroud 86 is retracted to the position illustrated by the broken line in FIG. 1. In this state, the shroud 86 is waiting for the next vehicle body to be painted. When the next vehicle body to be painted approaches the rotary type electrostatic spray painting device 1, the painting operation of the color B paint is started when the drive control device 94 produces a painting operation start signal.

As will be understood from the above description, where an amount of pressurized air sufficient to support the rotary shaft 4 in a non-contact state is not fed into the radial air bearings 18, 19 and the thrust air bearing, the solenoid valves 63 and 66 remain closed, regardless of the output voltage appearing in the output leads 95, 96. As a result, at this time, the injection of pressurized air from the air injection nozzles 46, 52 is stopped, and thus the rotation of the rotary shaft 4 is stopped. Consequently, it will be understood that the rotary shaft 4 is rotated only when it is supported by the radial air bearings 18, 19 and the thrust air bearing in a non-contact state. As a result, it is possible to prevent a seizure between the rotary shaft 4 and the rotary shaft 4 and the bearing faces, and thus ensure that the rotary shaft 4 will be able to rotate. In addition, when the rotary shaft 4 is rotated, the rotary shaft 4 is always supported in a non-contact state. Consequently, since it is possible to rotate the rotary shaft 4 at a predetermined regular speed, a uniform and aesthetically pleasing painted surface can be obtained.

According to the present invention, at the time of changing the color of the paint, since the paint remaining in the paint injection nozzle, the paint feed conduit, and the manifold is sucked out by means of the paint suction device, it is possible to reduce the amount of the paint to be cleaned off by a thinner. In addition, since the rotating speed of the spray head is rapidly decreased during the sucking operation of the suction device, it is possible to considerably reduce the time necessary for the color changing operation as compared with a conventional painting device. Consequently, it is possible to increase the speed of the conveyor, and thereby improve productivity.

While the invention has been described by reference to a specific embodiment chosen for purposes of illustration, it should be apparent that numerous modifications could be made thereto by those skilled in the art without departing from the basic concept and scope of the invention.

We claim:

1. A rotary type electrostatic spray painting device comprising:

a housing;

a rotary shaft rotatably arranged in said housing and having an inner end portion and an outer end portion;

a spray head fixed to said outer end portion of said rotary shaft and having a cup shaped inner wall;

a paint injection nozzle for feeding a paint onto said cup shaped inner wall;

at least two color valves connected to said paint injection nozzle for controlling the paint injecting operation from said paint injection nozzle;

paint suction means for sucking paint remaining in said paint injection nozzle;

means for generating a negative high voltage and applying said negative voltage to said spray head;

static pressure air bearing means arranged in said housing and supporting said rotary shaft in a non-contact state;

turbine wheel means fixed to said inner end portion of said rotary shaft;

a first air injection nozzle injecting pressurized air towards said turbine wheel means to rotate said rotary shaft in one direction;

a second air injection nozzle injecting pressurized air towards said turbine wheel means to provide a rotational force in another direction for said rotaty shaft and reduce a speed rotation of said rotary shaft;

an air source producing pressurized air;

a first air supply conduit interconnecting said air source to said static pressure air bearing means;

a second air supply conduit interconnecting said air source to said first air injection nozzle;

first valve means arranged in said second air supply conduit;

a third air supply conduit interconnecting said air source to said second air injection nozzle;

second valve means arranged in said third air supply conduit; and control means for controlling the opening operation of said first valve means and said second valve means and controlling the sucking operation of said paint suction means to open said first valve means; close said second valve means; and stop the sucking operation of said paint suction means when the painting operation is carried out, and to close said first valve means, open said second valve means, and carry out the sucking operation of said paint suction means when changing the paint color.

2. A rotary type electrostatic spray painting device according to claim 1, wherein said paint suction means comprises a paint suction device and a waste liquid tank connected to said paint injection nozzle via said paint suction device which sucks paint remaining in said paint injection nozzle into said waste liquid tank when changing the paint color.

3. A rotary type electrostatic spray painting device according to claim 1, wherein said color valves are mounted on a manifold connected to said paint injection nozzle, said paint suction means comprising a paint suction device connected to said manifold and sucking paint remaining in said paint injection nozzle and said manifold when changing paint color.

4. A rotary type electrostatic spray painting device according to claim 3, wherein said paint suction means comprises a suction control valve arranged between said paint suction device and said manifold, said valve being open when changing the paint color.

5. A rotary type electrostatic spray painting device according to claim 1, wherein said turbine wheel means comprises a first turbine wheel having turbine blades arranged to face said first air injection nozzle, and a second turbine wheel having turbine blades arranged to face said second air injection nozzle.

6. A rotary type electrostatic spray painting device according to claim 1, wherein said control means comprises a detecting device arranged in said first air supply conduit for detecting an amount of pressurized air fed into said static pressure air bearing means, a drive control device producing output signals denoting that said first valve means and said second valve means should be opened, and a valve control device actuating said first valve means and said second valve means in response to a signal output from said detecting device and signals output from said drive control device to selectively open said first valve means and said second valve means in accordance with the signals output from said drive control device when an amount of pressurized air fed into said static pressure air bearing means is larger than a predetermined amount.

7. A rotary type electrostatic spray painting device according to claim 6, wherein said detecting device comprises a detector detecting the pressure of pressurized air flowing within said first air supply conduit and producing an output signal indicating that said pressure of said pressurized air exceeds a predetermined pressure.

8. A rotary type electrostatic spray painting device according to claim 6, wherein said detecting device comprises a detector detecting the flow rate of pressurized air flowing within said first air supply conduit and producing an output signal indicating that said flow rate of said pressurized air exceeds a predetermined flow rate.

9. A rotary type electrostatic spray painting device according to claim 6, wherein said valve control device comprises a discriminating circuit by which one of said first valve means and said second valve means is opened when an amount of pressurized air fed into said static pressure air bearing means is larger than a predetermined amount and when said drive control device produces an output signal indicating that one of said first valve means and said second valve means should be opened.

10. A rotary type electrostatic spray painting device according to claim 9, wherein said discriminating circuit comprises a first AND gate and a second AND gate, said first AND gate comprising a first input terminal connected to said detecting device, a second input terminal connected to said drive control device and an output terminal connected to said first valve means, said second AND gate comprising a first input terminal connected to said detecting device, a second input terminal connected to said drive control device and an output terminal connected to said second valve means.

11. A rotary type electrostatic spray painting device according to claim 1, wherein said static pressure air bearing means comprises a pair of static pressure radial air bearings and a single static pressure thrust air bearing.

12. A rotary type electrostatic spray painting device according to claim 11, wherein each of said static pressure radial air bearings comprises a cylindrical bearing face and a plurality of air outflow bores formed on said cylindrical bearing face and connected to said first air supply conduit.

13. A rotary type electrostatic spray painting device according to claim 11, wherein said static pressure thrust air bearing comprises a pair of spaced runners fixed to said outer end portion of said rotary shaft, and an annular plate fixed to said housing and arranged between said runners, said runners having opposed end faces which are slightly spaced from said corresponding runners and having a plurality of air outflow bores formed on said opposed faces and connected to said first air supply conduit.

14. A rotary type electrostatic spray painting device according to claim 1, wherein said first air supply conduit, and second air supply conduit and said third air supply conduit are connected to said air source via a common main air supply conduit, and an air heating device is arranged in said main air supply conduit.

15. A rotary type electrostatic spray painting device according to claim 1, wherein said first valve means and said second valve means comprise a solenoid valve.

* * * * *